United States Patent [19]

Sciotti et al.

[11] Patent Number: 4,590,911

[45] Date of Patent: May 27, 1986

[54] FUEL INJECTION VALVE ASSEMBLY

[75] Inventors: Robert Sciotti, Warren; Dean E. Mocko, Mount Clemens, both of Mich.

[73] Assignee: Colt Industries Operating Corp., New York, N.Y.

[21] Appl. No.: 716,407

[22] Filed: Mar. 27, 1985

Related U.S. Application Data

[63] Continuation of Ser. No. 572,560, Jan. 20, 1984, abandoned.

[51] Int. Cl.[4] ..... F02M 39/00; F05B 1/00

[52] U.S. Cl. ..... 123/468; 123/514; 239/600; 239/DIG. 23; 239/602

[58] Field of Search ..... 123/468, 469, 470, 585, 123/514, 422, 446; 239/DIG. 19, DIG. 23, 600, 602, 88–95, 533.1–533.12

[56] References Cited

U.S. PATENT DOCUMENTS

| | | | |
|---|---|---|---|
| 1,241,069 | 9/1917 | Wittaker | 239/DIG. 23 |
| 2,068,593 | 1/1937 | Bork | 239/DIG. 23 |
| 2,332,535 | 10/1943 | Ross | 239/DIG. 23 |
| 2,645,527 | 7/1953 | Walters | 239/600 |
| 2,953,248 | 9/1960 | Troland | 239/602 |
| 3,334,818 | 8/1967 | Moen | 239/602 |
| 3,406,912 | 10/1968 | Claffey | 239/600 |
| 4,197,996 | 4/1980 | Giardini | 239/585 |
| 4,244,521 | 1/1981 | Guse | 239/600 |
| 4,281,797 | 8/1981 | Kimata | 123/468 |
| 4,437,611 | 3/1980 | Gilroy | 239/600 |

FOREIGN PATENT DOCUMENTS

| | | | |
|---|---|---|---|
| 3005857 | 9/1981 | Fed. Rep. of Germany | 123/470 |

*Primary Examiner*—Carl Stuart Miller

*Attorney, Agent, or Firm*—Walter Potoroka, Sr.

[57] ABSTRACT

A fuel metering apparatus is shown as having a throttle body with an induction passage therethrough and a throttle valve for controlling the flow of air therethrough; associated fuel metering and control apparatus is shown operatively connected to individual fuel injection valve assemblies respectively associated with respective cylinders of an internal combustion engine; such fuel injection valve assembly is shown as being constructed as to be capable of disassembly thereby enabling the replacement of components thereof, as need replacement, without the necessity of having to replace the entire fuel injection valve assembly when only a portion thereof actually needs replacement.

36 Claims, 12 Drawing Figures

FUEL INJECTION VALVE ASSEMBLY

This is a continuation of application Ser. No. 572,560 filed Jan. 20, 1984, now abandoned.

FIELD OF INVENTION

This invention relates generally to fuel injection systems and more particularly to fuel injection valve assemblies employed, within the overall system, for discharging fuel metered by the injection system to an associated combustion engine.

BACKGROUND OF THE INVENTION

Even though the automotive industry has over the years, if for no other reason than seeking competitive advantages, continually exerted efforts to increase the fuel economy of automotive engines, the gains continually realized thereby have been deemed by various levels of government as being insufficient. Further, such levels of government have also arbitrarily imposed regulations specifying the maximum permissible amounts of carbon monoxide (CO), hydrocarbons (HC) and oxides of nitrogen ($NO_x$) which may be emitted by the engine exhaust gas into the atmosphere.

Unfortunately, generally, the available technology employable in attempting to attain increases in engine fuel economy is contrary to that technology employable in attempting to meet the governmentally imposed standards on exhaust emissions.

For example, the prior art in attempting to meet the standards for $NO_x$ emissions has employed a system of exhaust gas recirculation whereby at least a portion of the exhaust gas is re-introduced into the cylinder combustion chamber to thereby lower the combustion temperature therein and consequently reduce the formation of $NO_x$.

The prior art has also proposed the use of engine crankcase recirculation means whereby the vapors which might otherwise become vented to the atmosphere are introduced into the engine combustion chambers for further burning.

The prior art has also proposed the use of fuel metering means which are effective for metering a relatively overly rich (in terms of fuel) fuel-air mixture to the engine combustion chamber means as to thereby reduce the creation of $NO_x$ within the combustion chamber. The use of such overly rich fuel-air mixtures results in a substantial increase in CO and HC in the engine exhaust which, in turn, requires the supplying of additional oxygen, as by an associated air pump, to such engine exhaust in order to complete the oxidation of the CO and HC prior to its delivery into the atmosphere.

The prior art has also heretofore proposed employing the retarding of the engine ignition timing as a further means for reducing the creation of $NO_x$. Also, lower engine compression ratios have been employed in order to lower the resulting combustion temperature within the engine combustion chamber and thereby reduce the creation of $NO_x$. In this connection the prior art has employed what is generally known as a dual bed catalyst. That is, a chemically reducing first catalyst is situated in the stream of exhaust gases at a location generally nearer the engine while a chemically oxidizing second catalyst is situated in the stream of exhaust gases at a location generally further away from the engine and downstream of the first catalyst. The relatively high concentrations of CO resulting from the overly rich fuel-air mixture are used as the reducing agent for $NO_x$ in the first catalyst while extra air supplied (as by an associated pump) to the stream of exhaust gases, at a location generally between the two catalysts, serves as the oxidizing agent in the second catalyst. Such systems have been found to have various objections in that, for example, they are comparatively very costly requiring additional conduitry, air pump means and an extra catalyst bed. Further, in such systems, there is a tendency to form ammonia which, in turn, may or may not be reconverted to $NO_x$ in the oxidizing catalyst bed.

The prior art has also proposed the use of fuel metering injection means for eliminating the usually employed carbureting apparatus and, under superatmospheric pressure, injecting the fuel through individual nozzles directly into either the respective cylinders of a piston type internal combustion engine or into the engine intake manifold at an area in close proximity to the respective or associated engine cylinder intake valve. Since the quantity of fuel thusly metered and ultimately discharged by such nozzle, per cycle, is relatively very small, the nozzle pintle and associated orifice is also relatively very small. This, in turn, requires that the metered fuel be as clean and free of entrained foreign particles as possible prior to its discharge between the pintle and discharge orifice because even a very small particle of foreign matter could lodge between the pintle valve and associated discharge orifice resulting in preventing the subsequent closure of the discharge orifice by the pintle valve.

The prior art has employed a filter within each of such injector nozzle assemblies generally immediately upstream of the pintle valve and discharge orifice to thereby filter-out any fuel-entrained foreign particles before such have a chance to reach the pintle valve and discharge orifice.

One of the problems of such prior art injector nozzle assemblies is that the overall body or housing is made of one-piece metal and upon the internally disposed filter becoming clogged, the entire injector nozzle assembly has to be discarded and replaced by an entirely new injector nozzle assembly at a high cost factor. The same applies to those situations where any other internally disposed component or element should fail.

Accordingly, the invention as disclosed and described is directed, primarily, to the solution of such and other related and attendant problems of the prior art.

SUMMARY OF THE INVENTION

In one aspect of the invention, a fuel injector nozzle assembly comprises a tubular elongated housing having a first inlet end and a second discharge end, said housing comprising first second and third housing portions detachably secured to each other in a series arrangement whereby said first housing portion has a first end comprising said first inlet end and a second end detachably connected to a first end of said second housing portion, wherein said second housing portion comprises a second end which is opposite to said first end of said second housing portion and detachably secured to a first end of said third housing portion, wherein said third housing portion has a second end opposite to said first end of said third housing portion and comprises said second discharge end, fuel flow passage means extending axially through said first second and third housing portions, fuel filter means, said fuel filter means being operatively carried by said second housing portion, said fuel filter means being situated in said fuel flow passage means and extending at least partly into said first housing portion when said first and second housing portions are detachably secured to each other via said second end of said first housing portion and said first end of said second housing portion, wherein said fuel flow passage means comprises a fuel discharge orifice operatively carried by said third housing portion, a valve, a valve stem, a movable spring seat, said valve being operatively carried generally at one operative end of said valve stem, said movable spring seat being operatively engaged at a second operative end of said valve stem generally opposite to said first operative end of said valve stem, and spring means situated generally in said fuel flow passage means, said spring means comprising a first spring end operatively engaging said third housing portion and a second spring end operatively engaging said movable spring seat, said spring means being effective to resiliently hold said valve closed against said fuel discharge orifice until such time as the pressure of the fuel within said fuel flow passage means causes an opening force against said valve exceeding the preload force of said spring means.

Various general and specific objects, advantages and aspects of the invention will become apparent when reference is made to the following detailed description considered in conjunction with the accompanying drawings.

BRIEF DESCRIPTION OF THE DRAWINGS

In the drawings, wherein for purposes of clarity certain details and/or elements may be omitted from one or more views.

DETAILED DESCRIPTION OF THE PREFERRED EMBODIMENT

Figure 1:
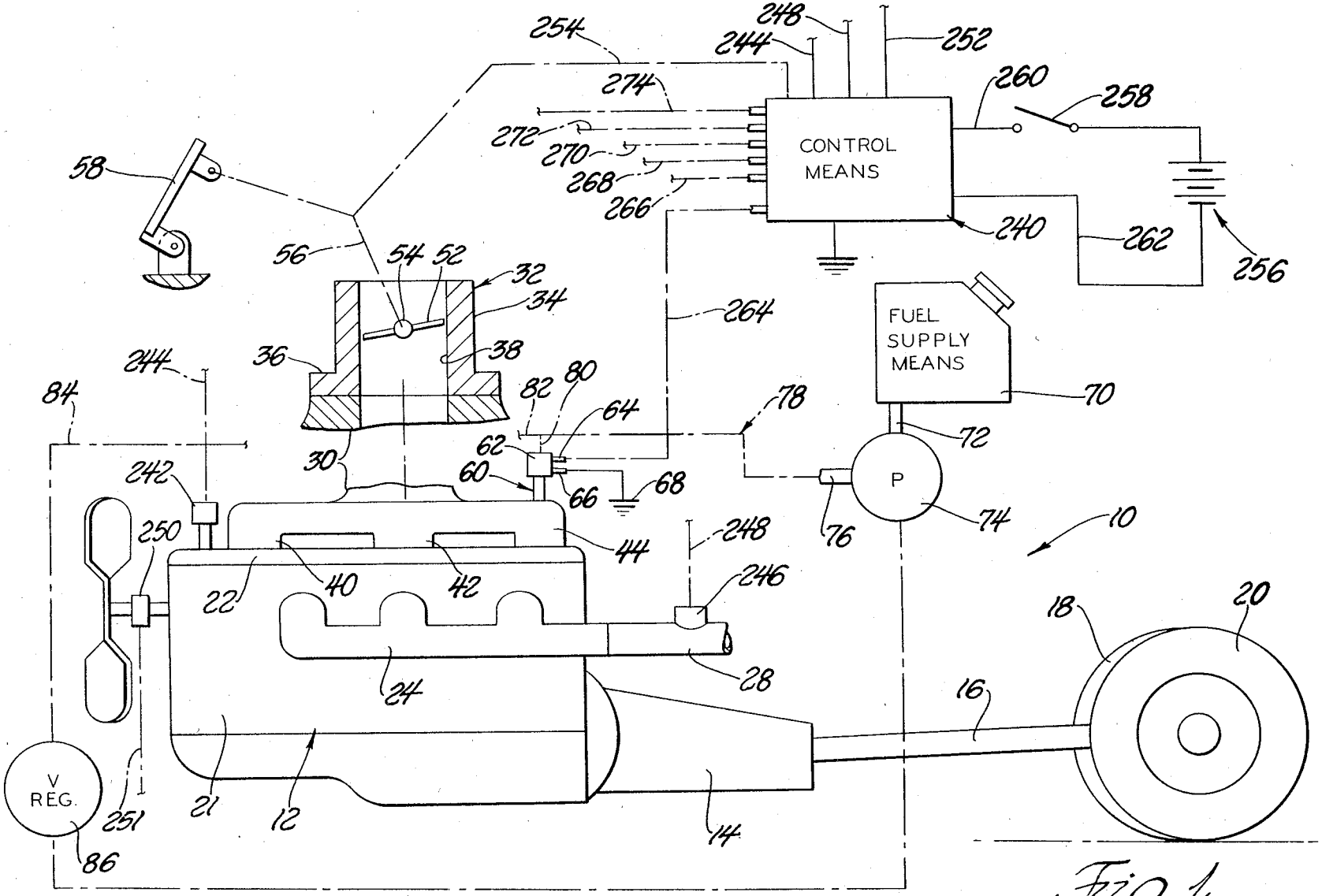
FIG. 1 illustrates, partly in simplified pictorial and partly in schematic, a vehicle having a combustion engine provided with a fuel metering and injection apparatus and system with injector nozzle means employing teachings of the invention.

Referring now in greater detail to the drawings, a vehicle 10 is illustrated as comprising a combustion engine 12 which, through suitable power transmission means 14, serves to propel, as through drive shaft means 16, associated vehicular ground engaging drive wheel means 18 and 20.

The engine 12 may be of the internal combustion type employing, as is generally well known in the art, a plurality of power piston means therein. As generally depicted, the engine assembly 12, is shown as being comprised of an engine block 21, and associated engine or cylinder head 22, with such engine block containing, among other things, a plurality of cylinders respectively reciprocatingly receiving said power pistons therein.

As is generally well known in the art, each cylinder containing a power piston has openable exhaust aperture or port means, timed for opening and closing in relation to engine crankshaft rotation and piston reciprocation, and such exhaust port means communicate as with associated exhaust manifold means 24 which, in turn, communicates with exhaust conduit means 28 leading as to the rear of the associated vehicle for the discharging of exhaust gases to the atmosphere. In four-cycle engines, the timed opening and closing of respective exhaust port means is accomplished by respective associated movable exhaust valve means.

Further, as is also generally well known in the art, each cylinder which contains a power piston also has openable inlet aperture or port means, timed for opening and closing in relation to engine crankshaft rotation and piston reciprocation, and such inlet or intake port means communicate as with associated inlet or intake manifold means 30.

As generally depicted, a throttle body assembly 32 is situated generally atop the intake manifold 30. The throttle body assembly 32 may be comprised of body means 34 and mounting flange or base portion 36 through which is formed an induction passage means 38 communicating with the various branch induction passages defined in the intake manifold 30 as within the runner portions, some of which are illustrated at 40, 42 and 44 leading as to the respective engine inlet or intake ports of the respective engine cylinders. A variably positionable throttle valve 52, carried as by throttle shaft means 54, is effective for controlling the rate of air through the induction passage means and into the said various branch induction passages. The throttle shaft 54 and throttle valve 52 may be operatively connected, as through suitable motion transmitting means 56, to vehicle operator positionable foot-pedal or lever means 58, as is generally well known in the art.

A plurality of injector nozzle assemblies are situated in and carried as by the intake manifold 30 as to have their respective discharge ends directed, for example, toward the respective intake valves and intake ports of the associated engine cylinders. One of such plurality of injector nozzle assemblies is typically illustrated, schematically, at 60. Each of such fuel injector nozzle assemblies 60, as also typically illustrated, may have a solenoid-operated on-off type valve assembly 62 operatively connected thereto upstream thereof. The valve assembly 62 may be provided with electrical terminals 64 and 66 with terminal 66 leading to ground as at 68.

The fuel supply system may comprise a fuel supply means 70 interconnected as via conduit means 72 to related fuel pumping means 74 which, in turn, is effective for pumping fuel at a superatmospheric pressure through outlet conduit portion 76 and into main fuel supply conduit means 78 from where branch fuel conduits, as typically illustrated at 80, supply fuel to the "on-off" solenoid valves as typically illustrated at 62, which, in turn, alternately permit and terminate fuel flow through the associated fuel injector valve assembly as, again, typically illustrated at 60. As should be noted, the main fuel supply conduit means 78 is fragmentarily illustrated as extending beyond branch conduit 80. Such extension, as depicted by portion 82 is intended to represent that such main fuel supply conduit means extends to and similarly communicates with other fuel injector valves not shown.

The main fuel supply conduit means 78 may then join as to a conduit portion 84 leading to related pressure regulating valving means 86 effective for bypassing and returning fuel, as via conduit means 88, to fuel supply means 82.

Figure 2:
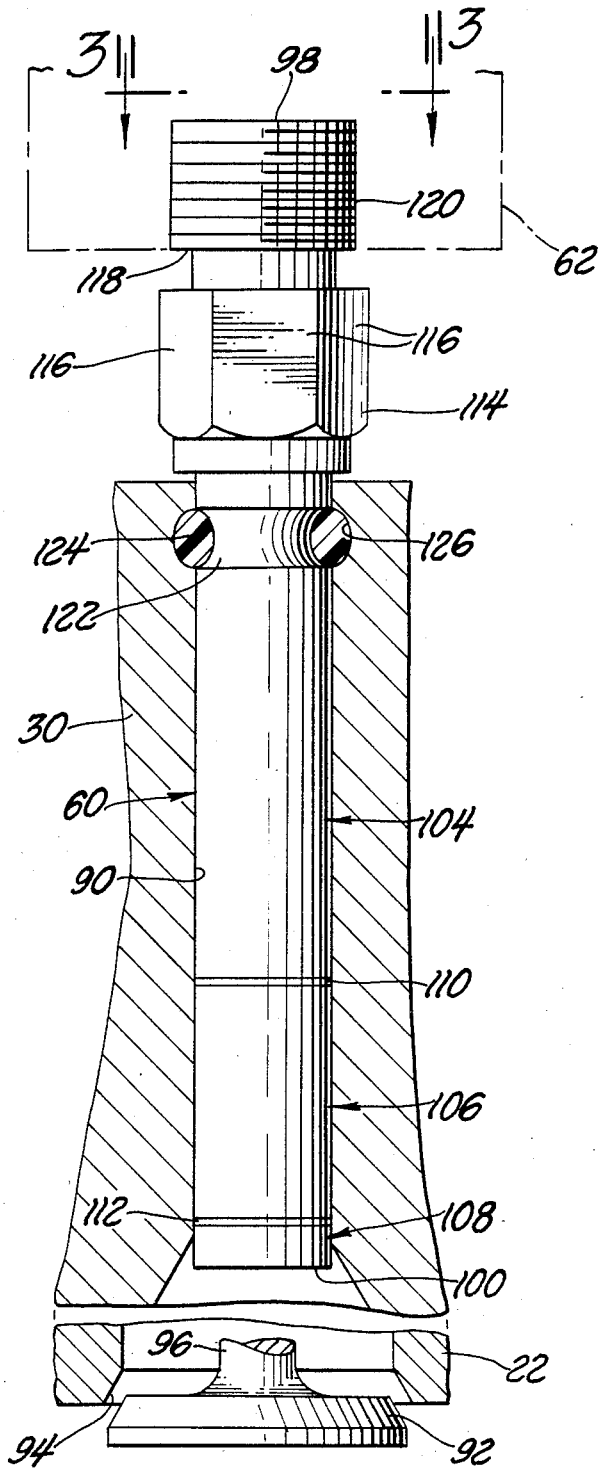
FIG. 2 is a relatively enlarged fragmentary cross-sectional view of a portion of the structure shown in FIG. 1 illustrating the injector nozzle means, in elevation, assembled to the engine and a fragmentary portion of the associated engine intake valve which, in reality may be in a plane different from that of the plane through which the upper portion of FIG. 2 is sectioned as generally indicated by the plane of line 2—2 of FIG. 3.
Figure 3:
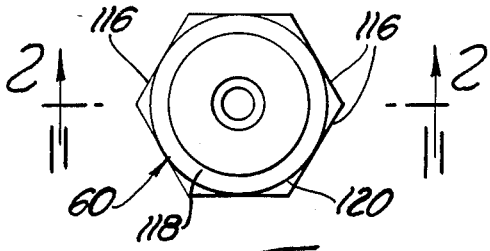
FIG. 3 is a view taken generally on the plane of line 3—3 of FIG. 2 and looking in the direction of the arrows.
Figure 4:
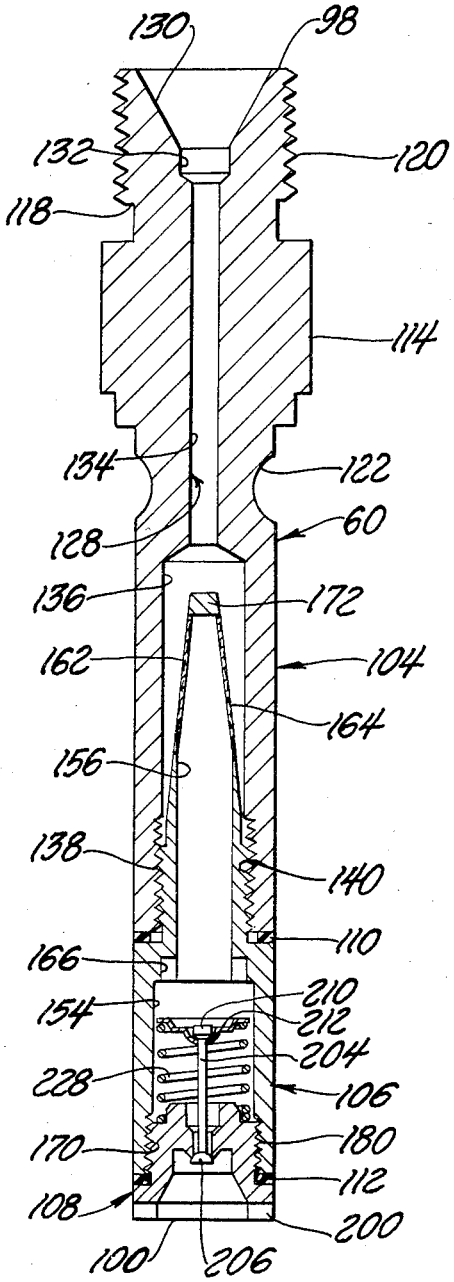
FIG. 4 is an axial cross-sectional view of the injector nozzle means or assembly taken generally on the plane of line 2—2 of FIG. 3 and looking in the direction of the arrows.

Referring in greater detail to FIGS. 2, 3 and 4, the injector valve assembly 60, in its preferred embodiment, shown in elevation, is illustrated as being closely received within a bore or cylindrical passage 90 formed as within, possibly, an enlarged portion of the intake or induction manifold 30.

The associated engine intake or inlet valve 92 is shown in at least a partly opened position and to that degree opening the cooperating cylinder inlet or intake port or aperture means 94. The intake valve 92 and valve stem 96 are shown as being axially aligned with the injector valve assembly 60. However, this is done primarily for simplicity and clarity of disclosure and such alignment is not necessary for the practice of the invention.

In any event, generally, the metered superatmospheric pressure fuel, when valve means 62 opens, flows into the inlet end 98 of injector valve assembly 60 and is ultimately discharged from the outlet or discharge end 100 of injector valve assembly 60 at least generally toward the then opened or opening inlet or intake port 94.

In the preferred embodiment, the overall housing or body 102 of the injector valve assembly 60, is comprised of three serially connected housings or housing portions 104, 106 and 108. Annular sealing means 110 and 112 are preferably provided, generally, between such housing portions as generally depicted by sealing means 110 being situated generally between and held by housing sections 104 and 106 while sealing means 112 is situated generally between and held by housing sections 106 and 108. In the embodiment such sealing means or gaskets 110 and 112 may be comprised of any suitable material and may, in fact, be of an O-ring configuration.

In the preferred embodiment, each of said housing sections 104, 106 and 108 are of outer cylindrical configuration with housing section 104, carrying a body portion 114 with tool-engaging surface means 116 and a further upwardly (as viewed in FIGS. 2 and 4) extending portion 118, externally threaded as at 120. The threaded portion 120 is effective for operative threadable connection as with the associated "on-off" solenoid valve assembly 62 while the tool-engaging surface means 116 may be employed operatively engaging suitable associated tool means (not shown) for assuring a tight threadable engagement as between the threaded portion 120 and the cooperating threaded portion operatively carried as by the "on-off" valve means 62.

As best seen in FIG. 2, in the preferred embodiment, housing section 104 is provided with an annular outer groove or recess 122 which is effective for partly receiving therein an elastomeric O-ring member 124, or the like, and the juxtaposed portion of the, for example, manifold 30 is provided with a generally complementary annular recess 126. By placing the elastomeric O-ring member 124 about and partly into annular recess 122 and then inserting the housing means 103 (comprising housing sections 104, 106 and 108) into the receiving passage 90, the elastomeric O-ring is first forced to resiliently deflect and then expand into outer annular groove or recess 126 thereby serving as fastening means for detachably securing the fuel injector assembly 60 to, for example, the manifold 30 as generally depicted in FIG. 2.

As possibly best shown in FIG. 4, the fuel injector valve assembly 60 comprises a generally axially or longitudinally extending fuel flow passage means 128 formed therethrough. As generally depicted, in the preferred embodiment, the fuel flow passage means 128 is provided or formed to have an enlarged cone-like inlet portion 130 so as to better funnel the flow of fuel as from the "on-off" valve means 62 into the passage means 128. Further, in the preferred embodiment, a countersink-like or annular chamber-like portion 132 functions to operatively interconnect the inlet portion 130 to a downstream conduit section 134. Also, in the preferred embodiment, the fuel flow passage means 128 comprises a comparatively enlarged conduit section 136 downstream of and communicating with conduit section 134. As generally depicted such conduit section 136 at least partly receives therein a portion of the housing section 106. In so receiving the housing section 106, an externally formed threaded portion 138 on the housing section 106 threadably engages a threaded portion 140 formed internally of the housing section 104 and, when such housing sections 104 and 106 are thusly tightly threadably engaged the sealing means 110 is tightly sealingly held therebetween.

Referring now in greater detail to FIGS. 5, 6, 7 and 8, in the preferred embodiment, the housing section 106 is illustrated as comprising a generally cylindrically tubular main body portion 142 with a generally axially upwardly (as viewed in FIG. 5) body extension 144, of comparatively reduced transverse cross-sectional size. As illustrated, the externally threaded portion 138 is carried by the body extension 144. As can be seen in both FIGS. 5 and 8 (as well as in FIG. 4) the extension 144 comprises a further body portion 146 upwardly (as viewed in any of FIGS. 4, 5 and 8) of the threaded section 138. As may be more easily understood or envisioned, the body portion 146 may be considered as being of outer cylindrical configuration, of a diameter, for example, receivable within conduit section 136 of housing section 104 and which, in turn, is cut at diametrally opposite sides as to result in inclined planes 147 and 149, inclined toward each other and each forming angles of, for example, 6° as represented by angles A and B in FIG. 5 when measured as from respective diametrally opposite points 148 and 150 on the cylindrical body extension 146.

Figure 5:
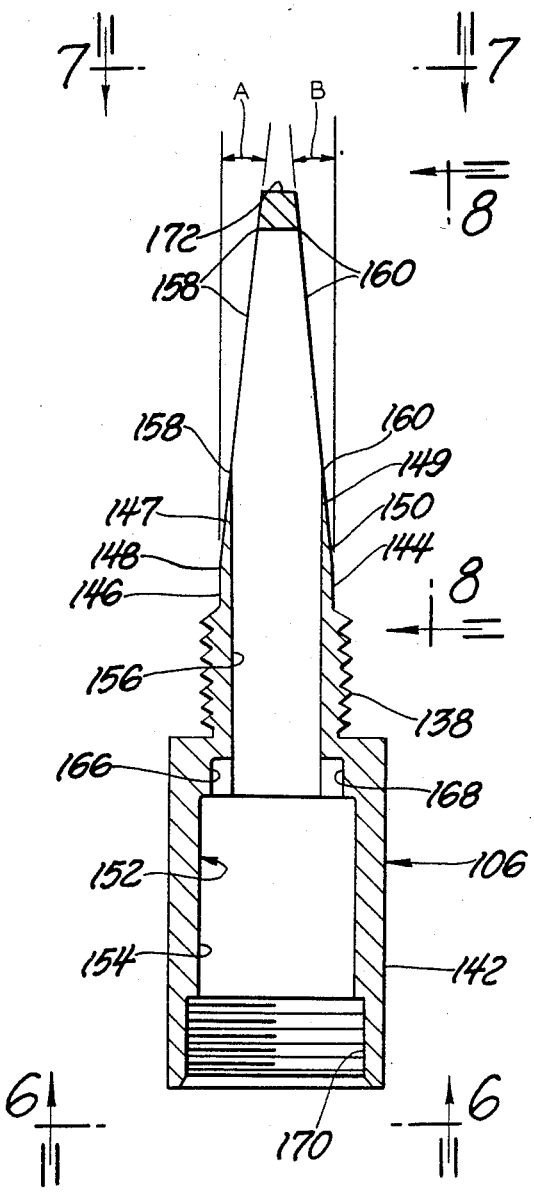
FIG. 5 is a further enlarged axial cross-sectional view of one of the elements shown in FIGS. 2 and 4.
Figure 7:
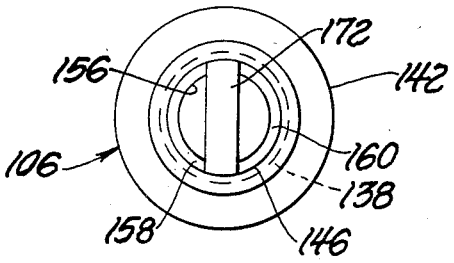
FIG. 7 is a view taken generally on the plane of line 7—7 of FIG. 5.

Conduit means 152 formed through body section 106 comprises a portion of the overall fuel passage means 128. As best seen in FIG. 5, a first relatively enlarged conduit section 154 is formed in the body portion 142 and communicates with a relatively smaller conduit section 156 formed, at least mainly, in body extension 146. Because of the body extension 146 being formed to have slanted or inclined surfaces 147 and 149, the generally upper end (as viewed in FIG. 5) of conduit section 156 forms opposed openings or apertures 158 and 160 which, in turn, serve to complete communication as between conduit section 136 of housing section 104 and conduit section 156 of body extension 146. As generally and typically depicted in FIG. 8, each of such openings or apertures 158 and 160 may have a shield-like peripheral configuration as typically depicted by aperture 160.

Figure 8:
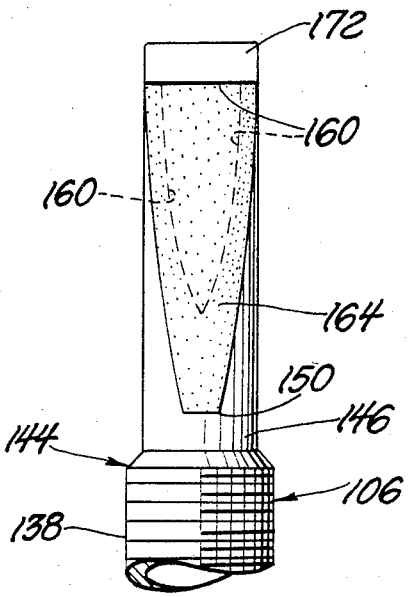
FIG. 8 is a fragmentary elevational view taken generally on the plane of line 8—8 of FIG. 5 and looking in the direction of the arrows.
Figure 6:
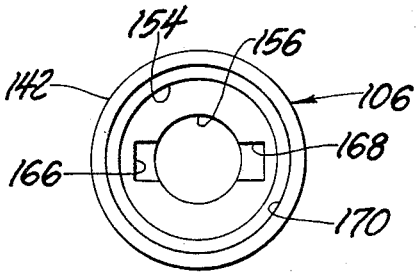
FIG. 6 is a view taken generally on the plane of line 6—6 of FIG. 5.

The body extension 146, in turn, carries fuel filter means 162 and 164 with such filter means 164 being shown in FIG. 8 while both fuel filter means 162 and 164 are illustrated in cross-section, carried by body extension 146, in FIG. 4.

The relatively enlarged body portion 142 is preferably formed with oppositely disposed internally formed recesses 166 and 168 which provide engaging surfaces by which, if necessary, suitable tool means may be engaged for tightly rotatably threadably engaging and connecting housing section 106 to upstream housing section 104. Further, as at the lower end (as viewed in FIG. 5) is provided with an internally threaded portion 170.

Although other suitable materials may be employed, in the preferred form of the housing section 106, such is molded from a 33.0 percent glass reinforced nylon. "Nylon" is a generic name for a family of polyamide polymers characterized by the presence of the amide group —CONH. Further, in the preferred form, a grade 71G33L "Zytel" or equivalent would be used to mold the entire housing section 106 including the molding therein of all passages, apertures, recesses and threaded portions "Zytel" is a registered United States of America trademark of the E.I. DuPont de Nemours, Co. of Wilmington, Delaware, United States of America, for a family of grades of nylon resin available as molding powder, extrusion powder and soluble resin. The particular grade of 71G33L, a glass fiber reinforced nylon resin, is further described as on Pages 2, 157, 158, 160, 161 and 174 of a Catalog No. E-21920 entitled *DuPont Zytel®, Design Handbook* published by said E.I. DuPont de Nemours, Co.

Further, in the preferred embodiment, the fuel filter means 162 and 164 are both formed on or molded directly to the body extension 146, during the process of molding the housing section 106, as to thereby cover or overlay the respective apertures 158 and 160 resulting in an arrangement as generally typically depicted in FIG. 8 whereby the upper end of each of such fuel filter means also operatively engages the upper tip-like portion 172 of the body extension 146. In the preferred embodiment, such filter means 162 and 164 are also formed of said grade 71G33L "Zytel" and of a 41 micron mesh size.

Figure 9:
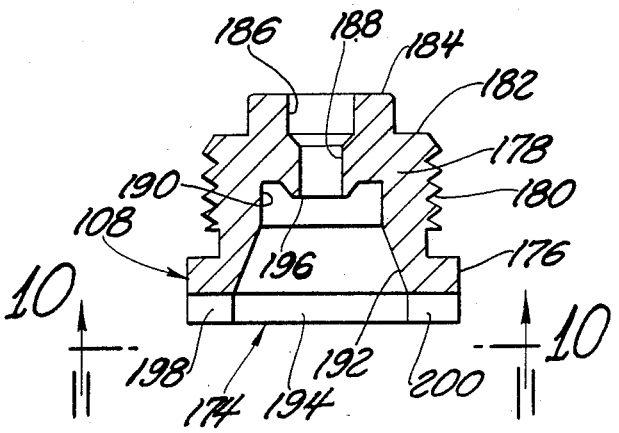
FIG. 9 is a further enlarged view of one of the elements shown in FIG. 4.
Figure 10:
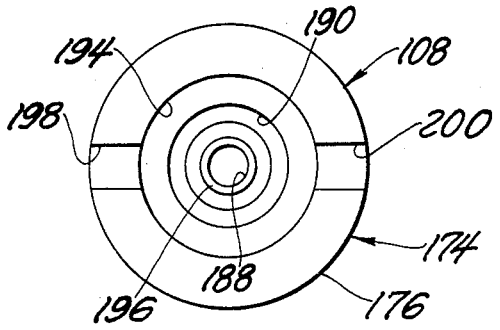
FIG. 10 is a view taken generally on the plane of line 10—10 of FIG. 9 and looking in the direction of the arrows.
Figure 11:
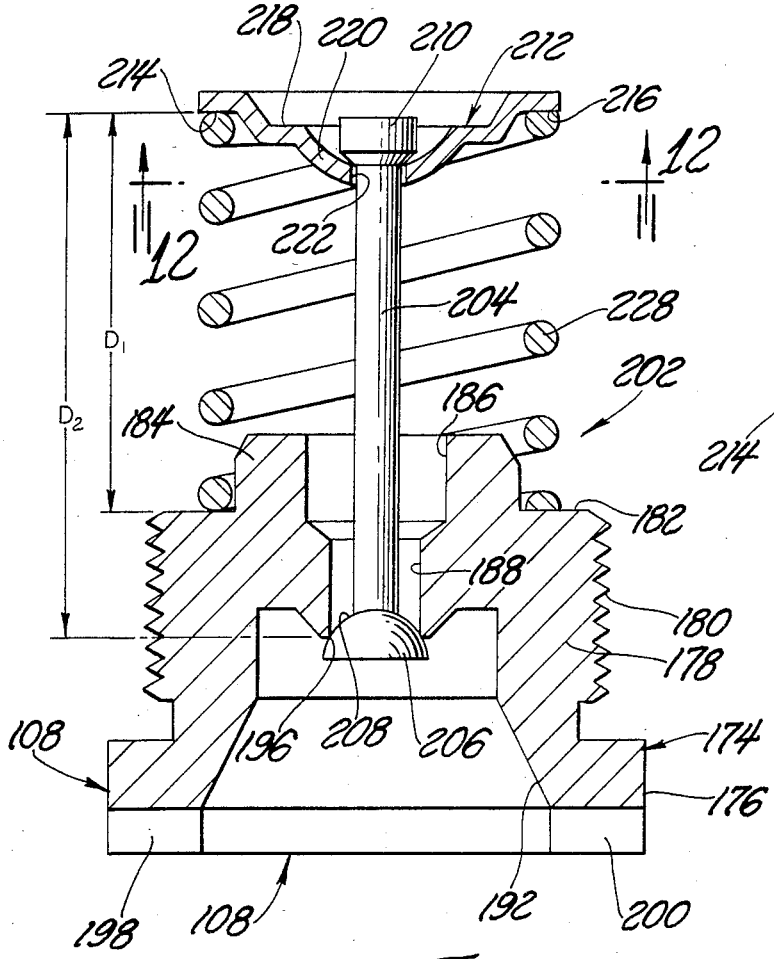
FIG. 11 is a further enlarged view of certain of the elements shown in FIG. 4 illustrated in a sub-assembly form.
Figure 12:
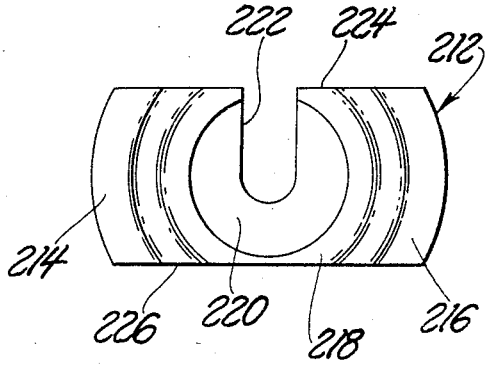
FIG. 12 is a view, of one of the elements shown in FIG. 11, taken generally on the plane of line 12—12 of FIG. 11 and looking in the direction of the arrows.

Referring in greater detail to FIGS. 9 and 10 along with FIGS. 11 and 12, the housing section 108 of FIGS. 2 and 4 is, in relatively enlarged scale, shown in FIG. 9 and 10 as comprising a body 174 having lower (as viewed in FIG. 9) generally cylindrical body portion 176 and an upwardly extending body portion 178 which has an externally threaded portion 180. The upwardly extending body portion 178 terminates as at a generally transverse annular shoulder or flange surface 182 and has a generally centrally disposed extension portion 184 which may be of generally cylindrical configuration.

Generally centrally disposed conduit sections 186, 188 and 190 formed primarily in body portion 178 and conduit sections 192 and 194 formed primarily in body portion 176 comprise a portion of said fuel flow passage means 128. In the preferred embodiment, conduit section 192 conically expands as it extends from conduit section 190 until it joins conduit section 194. In the preferred embodiment, the lower end of conduit section 188 terminates in a surrounding valve seat 196. Further, preferably, oppositely situated slots or recesses 198 and 200 are formed in the end of housing section 108 as to provide tool engaging surface means for operatively receiving tool means effective for tightly threadably engaging the housing section 108 to the upstream housing section 106.

The housing section 106, when assembled with other components as generally depicted in FIG. 11, comprises a valving assembly 202. As generally depicted in FIG. 11, a valve stem 204 carries, as at its lower end a valve member 206 having a preferably spherical surface 208, although the invention is not so limited, which at times is effective to be seated against the valve seat 196 for the termination of flow of fuel as between valve member 206 and seat or orifice 196. A disc-like head or abutment portion 210 is carried at generally the opposite end of the stem 204 and is of a size, which in actual practice may be of a cross-sectional diameter in the order of 0.054 inch, permitting the passage thereof through conduit section 188. In the preferred embodiment the head end 210, stem 204 and valve member 206 are made of unitary construction and, further, preferably formed of stainless steel. A movable spring seat member 212 is placed in operative engagement with the head or abutment portion 210 as by operatively engaging said head 210 at the underside thereof (as viewed in FIG. 11).

As can be seen in both FIGS. 11 and 12, the movable spring seat 212, preferably made of stainless steel, is formed as to have flat-surfaced arcuate flange portions 214 and 216, oppositely disposed to each other, carried as by a mid-disposed body portion 218 which, in turn, preferably, has a concave spherical or otherwise dished portion 220 centrally disposed and into which a clearance slot 222 is formed. The size of slot 222 is such as to generally closely accommodate the free reception therethrough of stem 204, which in actual practice may be of a cross-sectional diameter in the order of 0.029 inch, while still permitting operative engagement as between stem head 210 and spring seat portion 220. As best seen in FIG. 12, the spring seat member 212 is preferably of a strap-like configuration, having oppositely flatted or straight sides 224 and 226, rather than a full disc-like configuration.

A coiled compression spring 228 is situated about valve stem 204 and has one of its ends operatively engaged against the movable spring seat member 212 while its other end is operatively seated against flange or abutment surface 182 and generally piloted about the body extension 184. Although the invention is not so limited, in the preferred embodiment when the valve 206 is in its closed position the length, $D_1$, of spring 228 is less than the distance, $D_2$, as measured from the same upper end of spring 228 to the area at which the valve member 206 is sealingly seated against seating means 196.

Just as described with reference to housing section 106, so too housing sections 104 and 108 are preferably molded of said grade 71G33L "Zytel" although such, of course, may be comprised of any other suitable material, even stainless steel. However, the molding of such components as thusly described results in great savings of cost as would otherwise be associated with, for example, the formation of threads as by a cutting operation.

Referring again to FIG. 1, the control means 240 may comprise, for example, suitable electronic logic type control and power output means effective to receive one or more parameter type input signals and in response thereto produce related outputs. For example, engine temperature responsive transducer means 242 may provide a signal via transmission means 244 to control means 240 indicative of the engine temperature; sensor means 246 may sense the relative oxygen content of the exhaust gases (as within engine exhaust conduit means 28) and provide a signal indicative thereof via transmission means 248 to control means 240; engine speed responsive transducer means 250 may provide a signal indicative of engine speed via transmission means 252 to control means 240 while engine load, as indicated for example by throttle valve 52 position, may provide a signal as via transmission means 254 to control means 240. A source of electrical potential 256 along with related switch means 258 may be electrically connected as by conductor means 260 and 262 to control means 240.

Operation of Invention

Generally, in the embodiment disclosed, fuel under pressure is supplied as by fuel pump means 74 to conduit means 76 and 78 and from there to the plurality of respective branch conduits 80 leading to the respective associated on-off valve means 62 which, in turn, alternately, when energized and de-energized permit such metered superatmospheric pressure fuel to flow to and through the respective associated fuel injector nozzle assembly 60.

As is generally depicted in FIG. 1, the control means 240 has a plurality of, for example, output conductors 264, 266, 268, 270, 272 and 274 which, as typically illustrated by conductor means 264 leading to on-off valve means 62, respectively lead to respective ones of a plurality of such on-off valve assemblies. As engine loads and other operating parameters dictate, the control means, in selected sequence, energizes the on-off valves 62 to thereby open the flow of fuel to and through the related injector nozzle assembly. Generally, for example, as engine loads increase and the demand for fuel is thusly also increased, the control means 240 will keep open the on-off valve means 62 relatively longer than during such times as a lesser demand for fuel exists. In a system as depicted, the pressure of the fuel to be metered and injected is maintained by having the fuel pump 74 in effect supply an excess flow of fuel and having such excess returned via conduit means 84 and 88 and pressure regulator means 86 to the fuel reservoir 70.

The overall fuel system illustrated is by way of example others being employable in combination with the invention.

Referring now primarily to FIGS. 2, 4 and 11, and for ease of understanding, let it be assumed that the on-off valve assembly 62 is de-energized, closed, and that the fuel flow passage means 128 is completely filled with fuel and, further, that such fuel continues up to the point where flow has been terminated. At this time the pintle or needle-like valve 206 is in a closed condition because of spring 228 and no fuel flow is occurring through fuel flow passage means 128 or between valve member 206 and seat 196. Further, let it be assumed that the nozzle cracking pressure (that pressure at which the force against valve member 206 is sufficient to overcome the preload of spring 228 and open) is 0.025 lb. Therefore, while on-off valve assembly 62 is closed, the superatmospheric pressure of the fuel, possibly at a pressure of 40.0 p.s.i., is not applied to the non-flowing fuel within fuel flow passage means 128 and the preload of the spring (assumed to be 0.25 lb.) is sufficient to overcome the weight of the non-flowing fuel within fuel flow passage means 128 and maintain valve member 206 sealingly closed against valve seat 196.

Now let it be assumed that the control means 240 has energized the on-off valve means 62 to an open condition. This, in turn, causes the fuel flow pressure (assumed to be 40.0 p.s.i.) to be applied to the statically held fuel within fuel passage means 128 thereby increasing the pressure thereof accordingly. As a consequence of such an increase in the pressure of the fuel within fuel passage means 128, the resulting force applied against the effective area of valve member 206 overcomes the preload force of spring 228 causing the valve member 206 to move, in an opening direction, away from its cooperating seat 196.

As the valve member 206 is thusly opened the previously statically held fuel is sprayed into the intake manifold 30 generally in the vicinity of the then opened or about to be opened intake port means 94. The flow of pressurized fuel continues to flow through the fuel flow passage means 128 (illustrated as comprising 130, 132, 134, 136, 158, 160, 156, 154, 186 and 188) for that length of time during which the on-off valve means 62 is held open by the control means 240. When the control means 240 again closes on-off valve means 62 (or permits such to become closed) the assumed fuel line pressure of 40.0 p.s.i. communication to fuel flow passage means 128 is terminated and the pressure of the fuel then still within fuel flow passage means 128 decreases to, effectively, its static head pressure which enables spring 228 to again close the valve member 206 against its seat 196 terminating further fuel flow therepast and thereby completing that particular fuel injection cycle for that particular fuel injector nozzle assembly 60.

As should be evident, all fuel which ultimately passes through the valving assembly 202 must first flow through the filter means 162 and 164 thereby removing any foreign particles as may be entrained within the fuel and thereby eliminating the possibility of such foreign particles causing a malfunction in the coacting valve 206 and seat 196.

When the filter means becomes sufficiently clogged with foreign particles, fuel flow therethrough may be restricted to the degree that proper operation of the associated engine is impaired. Instead of having to discard the entire fuel injector nozzle assembly, as in the prior art, all that needs to be done, in the preferred embodiment of the invention, is to threadably remove the housing section 108 (which in the embodiment disclosed also comprises a valving assembly 202), threadably remove housing section 106 which carries the filter means 162 and 164. The thusly removed housing section 106 is then discarded and replaced by a new housing section 106 with clean filter means. After such replacement housing section 106 is threadably secured to housing section 104, the previously removed housing section 108 is once again threadably secured to the new housing section 106.

It can be seen that, generally, the same replacement procedure would be employed in the event there were to be any failure or damage to such elements or components as the valve 206, stem 204, stem head 210, spring 228 or spring seat 212. For example, if spring means 228 were to fail, all that would be necessary, with the invention, is to threadably remove the housing section 108, slip the spring seat 212 off of the stem 204, via slot 222, remove the failed spring and replace it with a new spring means 228 followed by the replacement of the original spring seat 212. After such replacement, the body section 108 would again be threadably secured to the housing section 104.

In addition to the preferred embodiment herein disclosed, it is further contemplated that the filter means could be detachably secured to and carried by the body extension 146 of housing section 106 so that upon clogging thereof only such filter means would be discarded.

It should also be pointed out that in the preferred embodiment the flow-through area defined by apertures or inlets 158 and 160 of housing extension 146 (of housing section 106) far exceeds the cross-sectional flow area of conduit section 156 thereby requiring a correspondingly relatively larger filter area through which the fuel will flow. By providing such a large filter area, a considerable degree of clogging of portions of the filter means can occur without an attendant impairment to the rate of fuel flow therethrough thereby effectively extending the useful life of such filter means.

Although only a preferred embodiment, and certain modifications, have been disclosed and described, it is apparent that other embodiments and modifications of the invention are possible within the scope of the appended claims.

What is claimed is:

1. A fuel injector nozzle assembly comprising a tubular elongated housing having a first inlet end and a second discharge end, said housing comprising first second and third housing sections detachably secured to each other in a series arrangement whereby said first housing section has a first end comprising said inlet end and a second end detachably connected to a first end of said second housing section, wherein said second housing section comprises a second end which is opposite to said first end of said second housing section and detachably secured to a first end of said third housing section, wherein said third housing section has a second end opposite to said first end of said third housing section and comprises said second discharge end, fuel flow passage means extending axially through said first second and third housing sections, fuel filter means, said fuel filter means being operatively carried by said second housing section, said fuel filter means being situated in said fuel flow passage means and extending at least partly into said first housing section when said first and second housing sections are detachably secured to each other via said second end of said first housing section and said first end of said second housing section, wherein said fuel flow passage means comprises a fuel discharge orifice operatively carried by said third housing section, a valve, a valve stem, a movable spring seat, said valve being operatively carried generally at one operative end of said valve stem, said movable spring seat being operatively engaged at a second operative end of said valve stem generally opposite to said first operative end of said valve stem, and spring means situated generally in said fuel flow passage means, said spring means comprising a first spring end operatively engaging said third housing section and a second spring end operatively engaging said movable spring seat, said spring means being effective to resiliently hold said valve closed against said fuel discharge orifice until such time as the pressure of the fuel within said fuel flow passage means causes an opening force against said valve exceeding the pre-load force of said spring means.

2. A fuel injector nozzle assembly according to claim 1 wherein at least a portion of said first housing section comprises an outer cylindrical surface.

3. A fuel injector nozzle assembly according to claim 1 wherein at least a portion of said second housing section comprises an outer cylindrical surface

4. A fuel injector nozzle assembly according to claim 1 wherein at least a portion of said third housing section comprises an outer cylindrical surface.

5. A fuel injector nozzle assembly according to claim 1 wherein each of said first second and third housing sections comprises an outer cylindrical surface.

6. A fuel injector nozzle assembly according to claim 1 wherein said first housing section comprises a first outer cylindrical surface, wherein said second housing section comprises a second outer cylindrical surface, wherein said third housing section comprises a third outer cylindrical surface, and wherein said first second and third outer cylindrical surfaces are of substantially equal diameter.

7. A fuel injector nozzle assembly according to claim 1 and further comprising first sealing means situated generally between and contained by said second end of said first housing section, and second sealing means situated generally between and contained by said second end of said second housing section and said first end of said third housing section.

8. A fuel injector nozzle assembly according to claim 1 wherein said first housing section is comprised of a plastic material.

9. A fuel injector nozzle assembly according to claim 1 wherein said second housing section is comprised of a plastic material.

10. A fuel injector nozzle assembly according to claim 1 wherein each of said first second and third housing sections is comprised of plastic material, and wherein said plastic material comprises a composition of glass and resin.

11. A fuel injector nozzle assembly according to claim 10 wherein said composition of glass and resin comprises nylon with a glass fiber filler.

12. A fuel injector nozzle assembly according to claim 1 wherein said second housing section and said fuel filter means are integrally molded to each other.

13. A fuel injector nozzle assembly according to claim 1 wherein said second housing section comprises a housing portion at least partly extending into said first housing section, a conduit section formed in said housing portion and comprising a portion of said fuel flow passage means, aperture means formed in said housing portion for permitting the flow of fuel from a point upstream in said fuel flow passage means through said aperture means and into said conduit section, and wherein said fuel filter means traverses at least a major portion of said aperture means for filtering foreign particles entrained in said fuel in said fuel flow passage means upstream of said aperture means.

14. A fuel injector nozzle assembly according to claim 13 wherein said aperture means comprises at least first and second apertures.

15. A fuel injector nozzle assembly according to claim 14 wherein said first and second apertures are formed as to be inclined with respect to the normal direction of flow of said fuel flowing through said fuel flow passage means upstream of said first and second apertures.

16. A fuel injector nozzle assembly according to claim 1 wherein said second housing section further comprises internally disposed tool-engaging surface means, said tool-engaging surface means being effective to be engaged by associated tool means for drivingly threadably operatively engaging said second housing section to said first housing section.

17. A fuel injector nozzle assembly according to claim 1 wherein said third housing section further comprises tool-engaging surface means, said tool-engaging surface means being effective to be engaged by associated tool means for drivingly threadably operatively engaging said third housing section to said second housing section.

18. A fuel injector nozzle assembly according to claim 1 wherein said movable spring seat comprises a constraining member operatively traversing and engaging said spring means, and wherein said constraining member comprises a clearance slot formed therein for freely receiving said valve stem therethrough.

19. A fuel injector nozzle assembly according to claim 1 wherein said first housing section comprises a threaded portion for operative connection to an associated source of fuel and further comprising tool-engaging surface means, said tool-engaging surface means being effective to be engaged by associated tool means for driving said first housing section into operative threadable engagement with said associated source of fuel.

20. In combination, a combustion engine, fuel metering apparatus for supplying metered rates of fuel flow to said engine, said fuel metering apparatus comprising body means, induction passage means formed through said body means for supplying motive fluid to said engine, throttle valve means situated in said induction passage means for variably controlling the rate of flow of air through said induction passage means, and fuel metering means for metering liquid fuel under superatmospheric pressure in response to engine demands and indicia of engine operation, said fuel metering means for metering liquid fuel comprising a fuel injector nozzle assembly for intermittently discharging metered fuel into said induction passage in the vicinity of an associated engine cylinder intake valve of said engine, said fuel injector nozzle assembly comprising a tubular elongated housing having a first inlet end and a second discharge end, said housing comprising first second and third housing portions detachably secured to each other in a series arrangement whereby said first housing portion has a first end comprising said inlet end and a second end detachably connected to a first end of said second housing portion, wherein said second housing portion comprises a second end which is opposite to said first end of said second housing portion and detachably secured to a first end of said third housing portion, wherein said third housing portion has a second end opposite to said first end of said third housing portion and comprises said second discharge end, fuel flow passage means extending axially through said first second and third housing portions, fuel filter means, said fuel filter means being operatively carried by said second housing portion, said fuel filter means being situated in said fuel flow passage means and extending at least partly into said first housing portion when said first and second housing portions are detachably secured to each other via said second end of said first housing portion and said first end of said second housing portion, wherein said fuel flow passage means comprises a fuel discharge orifice operatively carried by said third housing portion, a valve, a valve stem, a movable spring seat, said valve being operatively carried generally at one operative end of said valve stem, said movable spring seat being operatively engaged at a second operative end of said valve stem generally opposite to said first operative end of said valve stem, and spring means situated generally in said fuel flow passage means, said spring means comprising a first spring end operatively engaging said third housing portion and a second spring end operatively engaging said movable spring seat, said spring means being effective to resiliently hold said valve closed against said fuel discharge orifice until such time as the pressure of the fuel within said fuel flow passage means causes an opening force against said valve exceeding the pre-load force of said spring means.

21. A fuel injector nozzle assembly comprising a tubular elongated housing having a first inlet end and a second discharge end, said housing comprising first second and third housing sections detachably secured to each other in a series arrangement whereby said first housing section has a first end comprising said inlet end and a second end detachably connected to a first end of said second housing section, wherein said second housing section comprises a second end which is opposite to said first end of said second housing section and detachably secured to a first end of said third housing section, wherein said third housing section has a second end opposite to said first end of said third housing section and comprises said second discharge end, fuel flow passage means extending axially through said first second and third housing sections, fuel filter means, said fuel filter means being operatively carried by said second housing section, said fuel filter means being situated in said fuel flow passage means when said first and second housing sections are detachably secured to each other via said second end of said first housing section and said first end of said second housing section, and wherein said fuel flow passage means comprises a fuel discharge orifice operatively carried by said third housing section and effective to at least at times have the fuel within said fuel flow passage means flow through said fuel discharge orifice.

22. A fuel injector nozzle assembly according to claim 21 wherein at least a portion of said first housing section comprises an outer cylindrical surface.

23. A fuel injector nozzle assembly according to claim 21 wherein at least a portion of said second housing section comprises an outer cylindrical surface.

24. A fuel injector nozzle assembly according to claim 21 wherein at least a portion of said third housing section comprises an outer cylindrical surface.

25. A fuel injector nozzle assembly according to claim 21 wherein each of said first second and third housing sections comprises an outer cylindrical surface.

26. A fuel injector nozzle assembly according to claim 21 wherein said first housing section comprises a first outer cylindrical surface, wherein said second housing section comprises a second outer cylindrical surface, wherein said third housing section comprises a third outer cylindrical surface, and wherein said first second and third outer cylindrical surfaces are of substantially equal diameter.

27. A fuel injector nozzle assembly according to claim 21 and further comprising first sealing means situated generally between and contained by said second end of said first housing section, and second sealing means situated generally between and contained by said second end of said second housing section and said first end of said third housing section.

28. A fuel injector nozzle assembly according to claim 21 wherein each of said first second and third housing sections is comprised of plastic material.

29. A fuel injector nozzle assembly according to claim 28 wherein said plastic material comprises a composition of glass and resin, and wherein said composition of glass and resin comprises nylon with a glass fiber filler.

30. A fuel injector nozzle assembly according to claim 21 wherein said second housing section and said fuel filter means are integrally molded to each other.

31. A fuel injector nozzle assembly according to claim 21 wherein said second housing section comprises a housing portion at least partly extending into said first housing section, a conduit section formed in said housing portion and comprising a portion of said fuel flow passage means, aperture means formed in said housing portion for permitting the flow of fuel from a point upstream in said fuel flow passage means through said aperture means and into said conduit section, and wherein said fuel filter means traverses at least a major portion of said aperture means for filtering foreign particles entrained in said fuel in said fuel flow passage means upstream of said aperture means.

32. A fuel injector nozzle assembly according to claim 31 wherein said aperture means comprises at least first and second apertures.

33. A fuel injector nozzle assembly according to claim 32, wherein said first and second apertures are formed as to be inclined with respect to the normal direction of flow of said fuel flowing through said fuel flow passage means upstream of said first and second apertures.

34. A fuel injector nozzle assembly according to claim 21 wherein said second housing section further comprises internally disposed tool-engaging surface means, said tool-engaging surface means being effective to be engaged by associated tool means for drivingly threadably operatively engaging said second housing section to said first housing section.

35. A fuel injector nozzle assembly according to claim 21 wherein said third housing section further comprises tool-engaging surface means, said tool-engaging surface means being effective to be engaged by associated tool means for drivingly threadably operatively engaging said third housing section to said second housing section.

36. A fuel injector nozzle assembly according to claim 21 wherein said first housing section comprises a threaded portion for operative connection to an associated source of fuel and further comprising tool-engaging surface means, said tool-engaging surface means being effective to be engaged by associated tool means for driving said first housing section into operative threadable engagement with said associated source of fuel.

* * * * *